US007545100B2

(12) United States Patent
Genz

(10) Patent No.: US 7,545,100 B2
(45) Date of Patent: Jun. 9, 2009

(54) METAL HALIDE LAMP

(75) Inventor: Andreas Genz, Berlin (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 421 days.

(21) Appl. No.: 11/395,176

(22) Filed: Apr. 3, 2006

(65) Prior Publication Data

US 2006/0220564 A1 Oct. 5, 2006

(30) Foreign Application Priority Data

Apr. 1, 2005 (DE) ..... 20 2005 005 200 U

(51) Int. Cl.
*H01J 17/20* (2006.01)

(52) U.S. Cl. ..... 313/637; 313/491; 313/571

(58) Field of Classification Search ..... 313/637–643, 313/571, 491; 445/3, 16, 53
See application file for complete search history.

(56) References Cited

U.S. PATENT DOCUMENTS

| | | | |
|---|---|---|---|
| 5,965,984 | A | 10/1999 | Horiuchi et al. |
| 6,107,742 | A | 8/2000 | Seki et al. |
| 2004/0253897 | A1 | 12/2004 | Graf et al. |

FOREIGN PATENT DOCUMENTS

| | | | |
|---|---|---|---|
| DE | 198 14 353 | | 10/1998 |
| DE | 103 25 554 | | 12/2004 |
| EP | 1 455 382 | A2 | 9/2004 |
| EP | 1 511 068 | A2 | 3/2005 |

*Primary Examiner*—Joseph L Williams

(57) ABSTRACT

A metal halide fill for forming an ionizable fill comprises at least one inert gas, mercury and metal halides, the fill comprising the constituents In halide, Na halide, Tl halide and halides of the rare earths. This fill may in particular be contained in the discharge vessel of a metal halide lamp.

14 Claims, 4 Drawing Sheets

METAL HALIDE LAMP

TECHNICAL FIELD

The invention is based on a metal halide lamp for a high-pressure discharge lamp, having an ionizable fill comprising at least one inert gas, mercury and metal halides, with at least one halogen, the fill comprising Tl, Na and rare earths as metals for halides. It deals in particular with fills for lamps with a luminous color similar to daylight.

BACKGROUND ART

To achieve luminous colors similar to daylight, metal halide discharge lamps generally contain thallium. By way of example, U.S. Pat. No. 6,107,742 describes a lamp which contains a metal halide fill comprising the metals Cs, Tl, and rare earths, such as Dy, Tm, Ho, and has a luminous color similar to daylight.

Moreover, U.S. Pat. No. 5,965,984 has disclosed a fill for metal halide lamps which contains In halide. The fill may additionally contain metal halides comprising the metals rare earths, such as Tm, Ho with the exception of $DyI_3$. It is used for photo-optical purposes, i.e. for high luminous densities. In this case, the wall loading is typically 48 to 62 W/cm$^2$, the specific power is 35 to 70 W/mm arc length, and the electrode gap is less than 5 mm, while the quantity of lnI is 0.1 to 1.5 mg/ml.

US-A 2004253897 has disclosed a metal halide lamp with a two-ended outer bulb which surrounds only part of the discharge vessel.

DISCLOSURE OF THE INVENTION

It is an object of the present invention to provide a metal halide fill for metal halide discharge lamps, having an ionizable fill comprising at least one inert gas, mercury and metal halides, with at least one halogen, the fill comprising Tl, Na and rare earths as metals for halides, which are adapted to particular conditions of an outer bulb.

This object is achieved by the following features:

the fill additionally comprises In halide.

Particularly advantageous configurations are given in the dependent claims.

The invention uses a metal halide fill which uses Na, Tl and rare earths and, in addition, In halide. Other components with further halides are not used. The halogen used is iodine and/or bromine.

When producing metal halide lamps with discharge vessels made from quartz glass, it has been found that considerable cost savings can be achieved by using a new design with an outer bulb, in which the outer bulb only partially surrounds the discharge vessel. A gas fill is used in the outer bulb. However, this leads to an altered temperature balance for the discharge vessel. The fill comprising metal halides of Cs, Tl and rare earths that has hitherto been customary has too much of a green tinge under these conditions.

The accurately metered addition of indium halide remedies this problem. In this case, a fill which contains between 0.1 and 2.5 mg of rare earth halides per ml of volume of the discharge vessel is used. A value from 0.2 to 2.0 mg/ml is preferred. Suitable rare earths are in particular Dy, Ho and Tm alone or in combination. Tm on its own or predominantly, i.e. to an extent of more than 50%, in particular at least 90%, is particularly suitable.

The molar ratio between In and rare earths should be between 0.03 and 0.6, in particular between 0.04 and 0.4. The fill preferably contains more iodine than bromine. In particular, iodine alone is used, with a bromine content of at most 10% in molar terms.

The fill also contains Na halide, in particular Na iodide. The molar ratio between Na and rare earths is between 4 and 0.2, preferably between 3 and 0.3.

If the absolute fill quantity for rare earths is exceeded, the color temperature becomes too low. If the quantity of rare earths in the fill is below the absolute limit, the color temperature becomes too high.

If the molar ratio of In to rare earths is below the lower limit, the y component of the color locus becomes too high and the color locus has too much of a green tinge. If the molar ratio of In to rare earths exceeds the upper limit, the luminous flux becomes too low.

If the molar ratio of Na to rare earths is below the lower limit, the discharge arc becomes too constricted. If the molar ratio of Na to rare earths is above the upper limit, the color temperature is too low.

The color temperature of the lamp is preferably in the daylight region with a color temperature from 5000 to 6000 K. The specific power, given in watts per mm arc length, is preferably less than 30.

This fill is preferably suitable for general illumination purposes for low-wattage lamps with a rated power of at most 150 W. It is therefore used for low luminous densities. In this case, the wall loading is typically less than 40 W/cm$^2$, the specific power is less than 30 W/mm arc length, the electrode gap is more than 5 mm, the quantity of InI is less than 0.1 mg/ml, and is in particular from 0.03 to 0.075 mg/ml. It is in this way possible to achieve a long service life, typically of more than 4000 hours, and at the same time a high luminous flux.

BRIEF DESCRIPTION OF THE DRAWINGS

The text which follows is intended to provide a more detailed explanation of the invention on the basis of a number of exemplary embodiments. In the drawings.

BEST MODE FOR CARRYING OUT THE INVENTION

Figure 1:
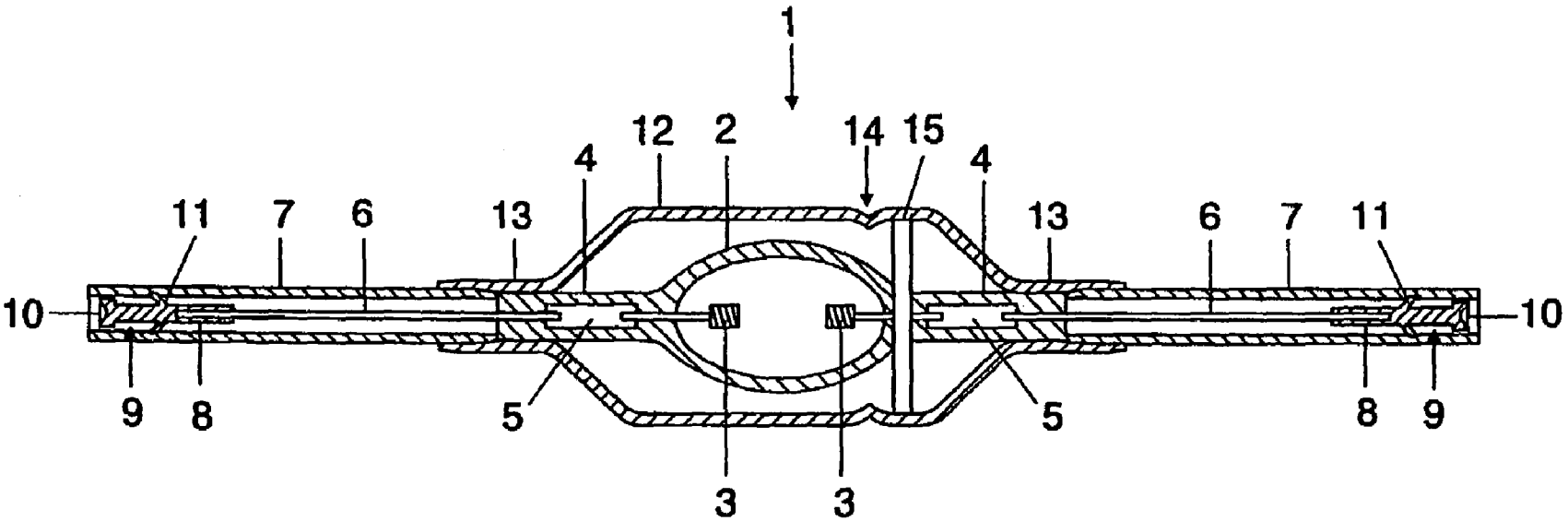
FIG. 1 shows a metal halide lamp according to the invention.
Figure 2:
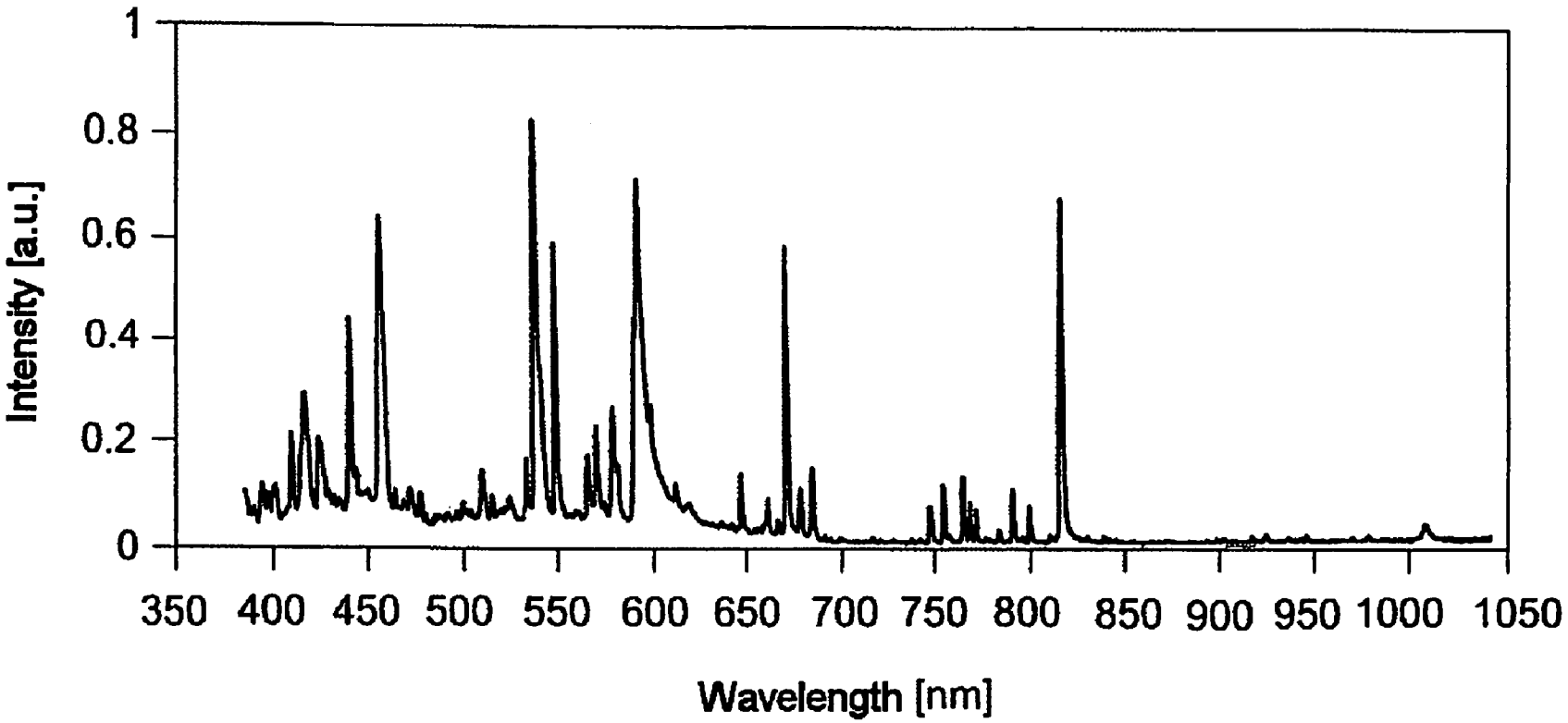
FIG. 2 shows a spectrum of this lamp.

FIG. 1 shows a side view of a metal halide lamp 1 with a rated power of 70 W which is pinched on two sides. The discharge vessel 2 made from quartz glass, which is designed in the shape of a barrel, encloses two electrodes 3 as well as a metal halide fill. The bulb ends are sealed by pinches 4, in which foils 5 are embedded. A fused seal is also suitable for sealing purposes. These pinches 4 are connected to external supply conductors 6. The external supply conductor 6 is guided within a tubular sleeve 7 and ends in a socket 8 of an integral cap part 9. The cap is produced in a single piece from steel or other heat-resistant metal and also comprises a circular disk 10 as contact element and barb 11 as centering and holding means. The convex part of the discharge vessel is partly surrounded by an outer bulb 12, which is rolled on (13) in the region of the transition between the pinch 4 and the sleeve 7.

The outer bulb 12 has an encircling indentation 14, so that an elastic support strip 15 made from metal is spread along the inner surface of the outer bulb. The support strip may if necessary contain getter materials, such as Zr, Fe, V, Co. These materials are used to absorb various substances, such as oxygen, hydrogen or the like. The outer bulb may be filled with nitrogen, noble gas, another inert gas or also a vacuum.

TABLE 1

| | Exemplary embodiment 1 (FIG. 3) | Exemplary embodiment 2 (FIG. 4) |
|---|---|---|
| Power/W | 73 | 73 |
| Luminous flux/lm | 5830 | 5350 |
| Color temperature/K | 5650 | 5480 |
| Color locus | 0.329/0.350 | 0.333/0.337 |
| Mean service life/h | 9000 | 9000 |
| Electrode gap/mm | 9.0 | 9.0 |
| Burner bulb diameter/mm | 11.0 | 11.0 |
| Burner bulb length/mm | 16.0 | 16.0 |
| Bulb volume/ml | 0.75 | 0.75 |
| Burner fill gas | 100 hPa Ar | 100 hPa Ar |
| Outer bulb fill gas | 300 hPa Ar | 300 hPa Ar |
| Fill in mg | 10 mg Hg,<br>0.04 mg InI,<br>0.70 mg TmI3,<br>0.11 mg TlI,<br>0.25 mg NaI | 10 mg Hg,<br>0.04 mg InI,<br>0.67 mg TmI3,<br>0.06 mg TlI,<br>0.34 mg NaI |
| Metals in mol % | Na 48% Tm 37%<br>Tl 10% In 5% | Na 59% Tm 33%<br>Tl 4% In 4% |

A higher or lower color temperature can be set by selecting the relative ratios of the metal halides. Two exemplary embodiments with different fills are shown in Table 1. As rare earth, the fill in each case uses Tm alone. Good results are also achieved with an addition of Dy and Ho, provided that Tm is used predominantly in a proportion of more than 50%.

Figure 3A:
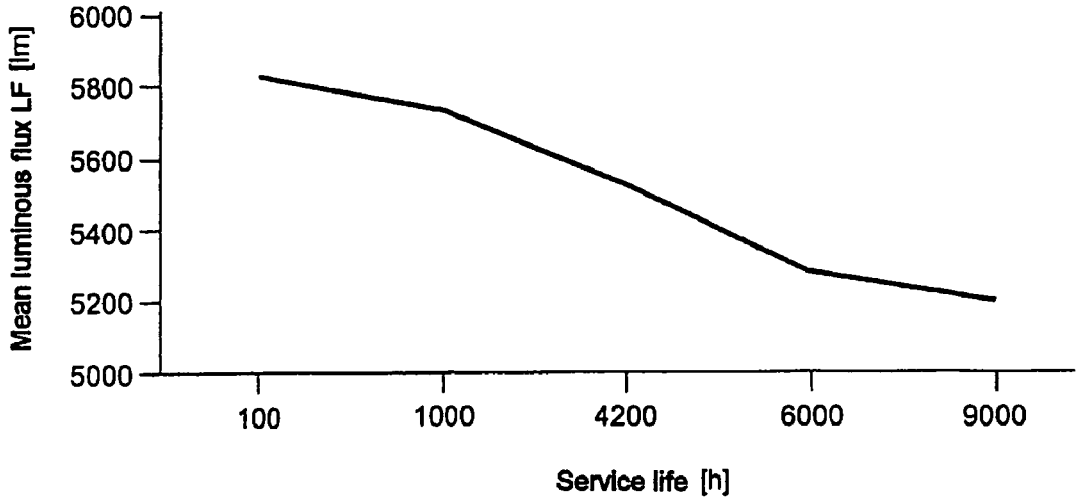
FIGS. 3 and 4 show the change in color temperature (FIGS. 3*b* and 4*b*) and luminous flux (FIGS. 3*a* and 4*a*) over the life for two exemplary embodiments.
Figure 3B:
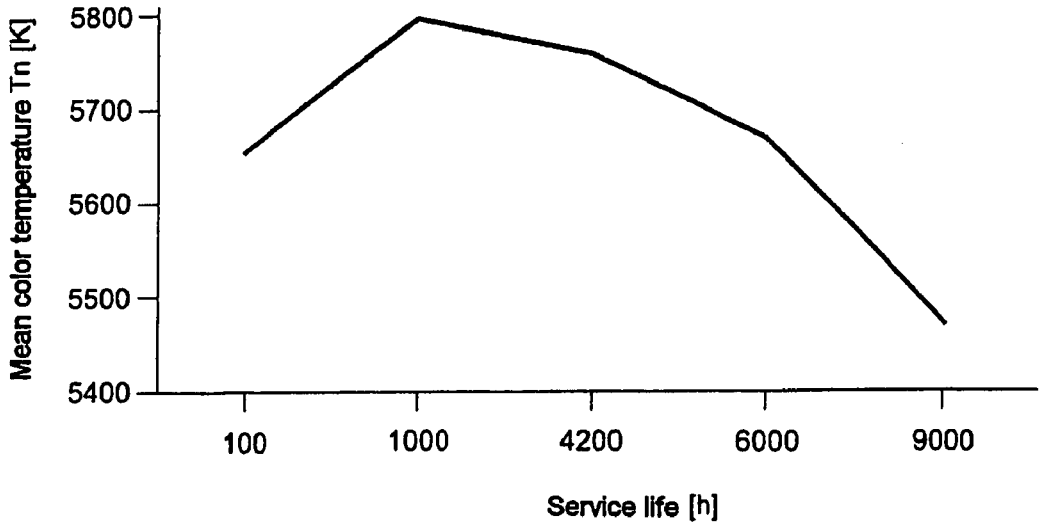
Figure 4A:
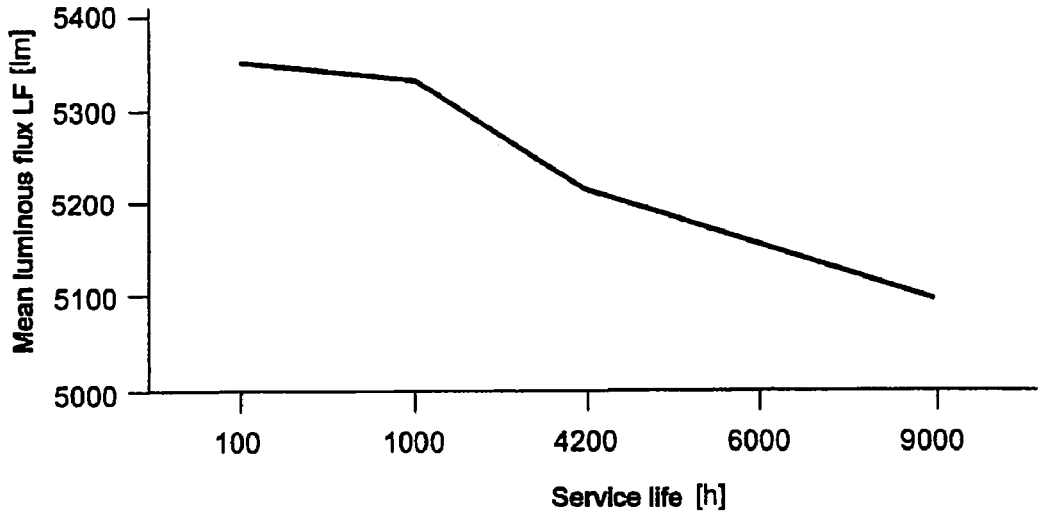
Figure 4B:
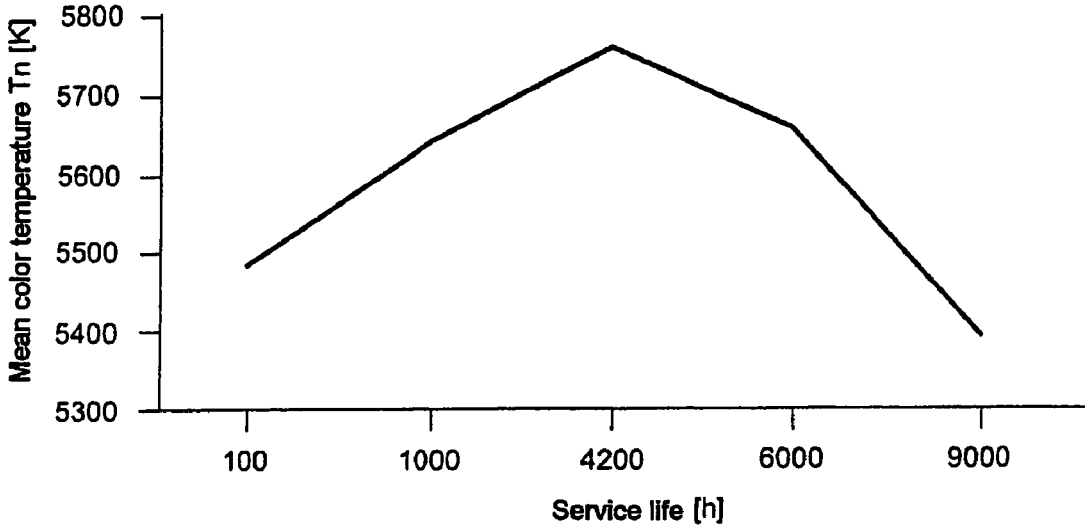

FIGS. 3 and 4 show the change in the color temperature Tn (FIGS. 3*b* and 4*b*) and in the luminous flux LF (FIGS. 3*a* and 4*a*) of the lamp from FIG. 1 as a function of the service life for the two exemplary embodiments shown in Table 1. Both characteristic variables are extremely stable up to a service life of at least 6000 hours. The first exemplary embodiment, cf. FIG. 3, is suitable for a higher luminous flux and a higher color temperature than the second exemplary embodiment.

What is claimed is:

1. A metal halide lamp having a color temperature from 5000 K to 6000 K with an ionizable fill comprising at least one inert gas, mercury and metal halides, with at least one halogen, the fill comprising Tl, Na and rare earths as metals for halides, wherein the fill additionally comprises In halide wherein the rare earth halide concentration is between 0.1 mg and than 2.5 mg of rare earth (RE) halide per ml of bulb volume of the discharge vessel.

2. The metal halide lamp as claimed in claim 1, wherein at least one halide from the group of the rare earths Dy, Ho, Tm is used.

3. The metal halide lamp as claimed in claim 1, wherein the fill contains between 0.2 and 2.0 mg of RE halide per ml of bulb volume of the discharge vessel.

4. The metal halide lamp as claimed in claim 1, wherein the halogens used for forming halides are from the group comprising iodine and bromine.

5. The metal halide lamp as claimed in claim 4, wherein iodine with a proportion of at most 10% of bromine is used as the halogen.

6. The metal halide lamp as claimed in claim 1, wherein the molar ratio between indium and rare earths is between 0.03 and 0.6.

7. The metal halide lamp as claimed in claim 1, wherein the fill contains between 0.03 and 0.075 mg of In halide per ml of bulb volume of the discharge vessel.

8. The metal halide lamp as claimed in claim 1, wherein the molar ratio between sodium and rare earths is between 4.0 and 0.2.

9. The metal halide lamp as claimed in claim 1, wherein the lamp also comprises: an outer bulb made from hard glass or quartz glass and a discharge vessel (2) made from quartz glass and containing two electrodes (11), with the outer bulb only partially surrounding the discharge vessel, and with a space between the discharge vessel and the outer bulb.

10. The metal halide lamp as claimed in claim 8, wherein the space between discharge vessel and outer bulb contains a gas fill.

11. The metal halide lamp as claimed in claim 9, wherein the gas fill consists of 200 to 900 mbar $N_2$ or noble gas or $CO_2$ alone or in combination.

12. The metal halide lamp as claimed in claim 1, wherein at least one halide from the group of the rare earths Dy, Ho, Tm is used, and the Tm comprises at least 50% weight percent of all the rare earths.

13. The metal halide lamp as claimed in claim 6, wherein the molar ratio between indium and rare earths is between 0.04 and 0.4.

14. The metal halide lamp as claimed in claim 8, wherein the molar ratio between sodium and rare earths is between 3.0 and 0.3.

* * * * *